US007977564B2

(12) United States Patent
Takigawa

(10) Patent No.: US 7,977,564 B2
(45) Date of Patent: Jul. 12, 2011

(54) ELECTRONIC KEYBOARD MUSICAL INSTRUMENT

(75) Inventor: Souichi Takigawa, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/508,842

(22) Filed: Jul. 24, 2009

(65) Prior Publication Data

US 2010/0018378 A1 Jan. 28, 2010

(30) Foreign Application Priority Data

Jul. 24, 2008 (JP) ..... 2008-190675

(51) Int. Cl.
*G10D 15/00* (2006.01)

(52) U.S. Cl. ..... 84/670; 84/171; 84/609; 84/615; 84/622; 84/625; 84/626; 84/656

(58) Field of Classification Search ..... 84/609, 84/615, 622, 625, 626, 656, 660, 426, 171, 84/670

See application file for complete search history.

(56) References Cited

U.S. PATENT DOCUMENTS

| | | | | | |
|---|---|---|---|---|---|
| 4,909,121 | A * | 3/1990 | Usa et al. | 84/606 |
| 5,001,339 | A * | 3/1991 | Starkey et al. | 250/229 |
| 5,131,306 | A * | 7/1992 | Yamamoto | 84/19 |
| 5,136,916 | A * | 8/1992 | Shibukawa | 84/627 |
| 5,498,834 | A * | 3/1996 | Inagaki et al. | 84/622 |
| 5,523,522 | A * | 6/1996 | Koseki et al. | 84/21 |
| 5,569,870 | A * | 10/1996 | Hirano | 84/615 |
| 5,648,629 | A * | 7/1997 | Kozuki | 84/660 |
| 5,744,743 | A * | 4/1998 | De Poli et al. | 84/630 |
| 5,905,220 | A * | 5/1999 | Lee et al. | 84/461 |
| 5,922,983 | A * | 7/1999 | Muramatsu | 84/626 |
| 6,121,535 | A * | 9/2000 | Muramatsu | 84/626 |
| 6,201,173 | B1 * | 3/2001 | Black | 84/422.1 |
| 6,528,713 | B2 * | 3/2003 | Maehara | 84/426 |
| 6,576,826 | B2 * | 6/2003 | Kondo et al. | 84/615 |
| 6,762,357 | B2 * | 7/2004 | Washiyama et al. | 84/603 |
| 7,470,847 | B2 * | 12/2008 | Kitagawa | 84/422.1 |
| 7,470,855 | B2 * | 12/2008 | Sakama et al. | 84/626 |
| 7,476,797 | B2 * | 1/2009 | Izumisawa et al. | 84/660 |
| 7,612,274 | B2 * | 11/2009 | Nakata | 84/423 R |
| 7,642,445 | B2 * | 1/2010 | Izumisawa | 84/622 |
| 2007/0256550 | A1 * | 11/2007 | Muramatsu | 84/719 |
| 2008/0245213 | A1 * | 10/2008 | Izumisawa | 84/604 |
| 2009/0205476 | A1 * | 8/2009 | Komatsu | 84/17 |
| 2009/0229440 | A1 * | 9/2009 | Iwamoto et al. | 84/229 |

(Continued)

FOREIGN PATENT DOCUMENTS

| | | |
|---|---|---|
| JP | 6149246 | 5/1994 |

(Continued)

*Primary Examiner* — Jeffrey Donels
*Assistant Examiner* — Robert W Horn
(74) *Attorney, Agent, or Firm* — Morrison & Foerster LLP

(57) ABSTRACT

In normal mode or expansion mode, a normal load table 53 or an expansion load table 54 is selected, respectively, to store half area start position HS and half area end position HE as effect-switchable positions. The selected load table is referenced to generate and output drive signals so as to obtain depression reaction force F according to position ST. In accordance with player's depression/release of keys, musical tone signals are generated on the basis of waveform data 51 and envelope data 52 corresponding to the manipulated keys, designated basic tone color and depression area to carry out tone emission/tone-vanishing processes. Both the characteristics of musical tones and the rate of change in the reaction force switch at the effect-switchable positions.

9 Claims, 6 Drawing Sheets

U.S. PATENT DOCUMENTS

2009/0235803 A1* 9/2009 Iwamoto et al. ..... 84/229
2009/0314156 A1* 12/2009 Komatsu ..... 84/626
2010/0018378 A1* 1/2010 Takigawa ..... 84/171
2010/0089225 A1* 4/2010 Maruyama ..... 84/626
2010/0107857 A1* 5/2010 Hasebe ..... 84/615
2010/0175545 A1* 7/2010 Muramatsu ..... 84/746
2010/0229711 A1* 9/2010 Muramatsu et al. ..... 84/746
2010/0269670 A1* 10/2010 O'Connor et al. ..... 84/626
2010/0307322 A1* 12/2010 Tominaga ..... 84/622

FOREIGN PATENT DOCUMENTS

JP 8211869 8/1996

* cited by examiner

ELECTRONIC KEYBOARD MUSICAL INSTRUMENT

FIELD OF THE INVENTION

The present invention relates to an electronic keyboard musical instrument which controls musical tones by pedal manipulation.

DESCRIPTION OF THE RELATED ART

Conventionally, electronic keyboard musical instruments which controls musical tones by pedal manipulation such as a damper pedal are known. For example, Japanese Unexamined Patent Publication No. H8-211869 discloses an art for varying tone color according to the amount of depression of a pedal, that is, the art for producing the so-called soft pedal effect. In addition, Japanese Unexamined Patent Publication No. H6-149246 discloses an art for generating musical tones having a damper pedal effect during depression of a damper pedal and generating musical tones without the damper pedal effect while the damper pedal is not being depressed.

Furthermore, an electronic keyboard musical instrument is also known that is provided with a multi-tone generator to allow concurrent generation of musical tones of two or more tone colors by a depression of a key. On the musical instrument of this type, to the musical tones of the first tone color such as piano, resonance tones (tones generated by resonance and vibration of strings that are capable of resonating and vibrating in a state of half pedaling on an acoustic piano) begin to be added at a half pedal position in the course of a depression of a pedal, while to the second tone color that sustains such as the strings, an effect equivalent to after-touch such as vibrato begins to be added at a certain position situated immediately before the end of a depression of the pedal.

DISCLOSURE OF THE INVENTION

Problems to Be Solved by the Invention

However, each conventional instrument has a fixed timing which is a fixed position in the course of a depression of the pedal, the fixed position being the position at which the effect such as resonance tones and after-touch begins to be added. In other words, each conventional instrument has a fixed position where musical tone parameters are switched. On such a conventional instrument, the position is fixed and invariable. Therefore, such conventional electronic keyboard musical instruments have plenty of room for improvement in view of enriching player's performance.

In general, furthermore, the position where musical tone parameters are switched is perceived by a player with his ears, relying on emitted tones. Therefore, there is also a problem that it is difficult for beginners to grasp the position.

The present invention was accomplished to solve the above-described problems, and an object thereof is to provide an electronic keyboard musical instrument which enables a player to set pedal depression position where the musical tone control such as addition of effect is switched at the player's desired positions.

Means for Solving the Problems

In order to achieve the above-described object, it is a feature of the present invention to provide an electronic keyboard musical instrument comprising musical tone signal generating means (19) for generating a musical tone signal; a plurality of key operators (13); a pedal (22); position sensing means (42) for sensing position of the depressed pedal; position storing means (RAM of 50) for storing as a switchable position at least one position in a direction in which the pedal is depressed; musical tone controlling means (S107) for controlling the musical tone signal generating means by use of a musical parameter in accordance with manipulation of the key operators and manipulation of the pedal to generate a musical tone signal as well as switching the musical tone signal which is to be generated by switching the musical tone parameter (51, 52) when the depressed pedal position sensed by the position sensing means crosses over the switchable position (HS, HE, P2, P3) stored in the position storing means; and position changing means (S103, S104) for changing the switchable position stored in the position storing means in accordance with user's manipulation.

In this case, the pedal is a damper pedal, for example. The musical tone controlling means switches the musical tone parameter to switch between generation of a musical tone signal without a resonance tone and generation of a musical tone signal with a resonance tone, for example. The musical tone parameter is waveform data indicative of a waveform of a musical tone to be generated, for example.

Furthermore, the musical tone controlling means switches the musical tone parameter to switch between generation of a musical tone signal without vibrato and generation of a musical tone signal with vibrato, for example.

According to this feature, the position changing means changes the switchable position stored in the position storing means, enabling the player to set the pedal depression position where the musical tone control such as addition of effect is switched at his desired position.

It is another feature of the present invention to configure the musical tone signal generating means, the position storing means, the musical tone controlling means and the position changing means as follows. The musical tone signal generating means concurrently generates musical tone signals of different kinds of tone colors. The position storing means stores, for each of the respective tone colors, as a switchable position at least one position in the direction in which the pedal is depressed. The musical tone controlling means switches, for each of the respective tone colors, the musical tone parameter to switch the musical tone signal to be generated when the depressed pedal position sensed by the position sensing means crosses over the switchable position stored in the position storing means. The position changing means changes, for each of the respective tone colors, the switchable position stored in the position storing means in accordance with user's manipulation. The another feature enables the player to set, for the respective tone colors which are to be emitted concurrently, the pedal depression position where the musical tone control such as addition of effect is switched at his desired position.

It is a further feature of the present invention to further comprise reaction force generating means for generating reaction force against depressing manipulation of the pedal; and reaction force controlling means for controlling the reaction force generating means in accordance with the depressed pedal position sensed by the position sensing means. The reaction force controlling means varies rate of change in the reaction force exerted on the pedal at least when the depressed pedal position sensed by the position sensing means crosses over the switchable position stored in the position storing means.

More specifically, the electronic keyboard musical instrument further comprises load data storing means for storing different kinds of load data each indicative of reaction force which is to be exerted on the pedal and varies according to the depressed pedal position; and selecting means for selecting, in accordance with user's manipulation, any of the different kinds of load data stored in the load data storing means. The reaction force controlling means controls the reaction force generating means by use of the selected load data in accordance with the depressed pedal position sensed by the position sensing means. The position changing means changes the switchable position stored in the position storing means in response to the selection of the load data by the selecting means.

In this case, the switchable position stored in the position storing means includes a first and second positions situated between a position where a depression of the pedal starts and a position where the depression of the pedal ends, for example. The reaction force controlling means controls the reaction force generating means so that, in a course of the depression of the pedal, the rate of change in the reaction force to be exerted on the pedal grows at the first position and decreases at the second position. The switchable position stored in the position storing means is near the position where the depression of the pedal ends, for example. The reaction force controlling means controls the reaction force generating means so that, in a course of the depression of the pedal, the rate of change in the reaction force to be exerted on the pedal grows at the switchable position and temporarily decreases just before the position where the depression ends.

The further feature of the present invention enables linkage between the switching of the musical tone control and the switching of the rate of change in the reaction force exerted on the pedal depression, allowing the player to perceive, with his foot, the positions in the direction of pedal depression where the musical tone control switches. In the case where the switchable position includes the first and second positions situated between the position where the pedal depression starts and the position where the pedal depression ends, particularly, the player is able to perceive, with his foot, the positions where a change is made to the effect to be added to musical tones when he depresses the pedal (damper pedal) having a half pedal area. In the case where the switchable position is near the position where the pedal depression ends, the player is able to perceive, with his foot, the position where a change such as addition of after-touch effect to musical tones is made to the musical tones.

DESCRIPTION OF THE PREFERRED EMBODIMENT

Embodiments of the present invention will now be described with reference to the drawings.

A. First Embodiment

Figure 1:
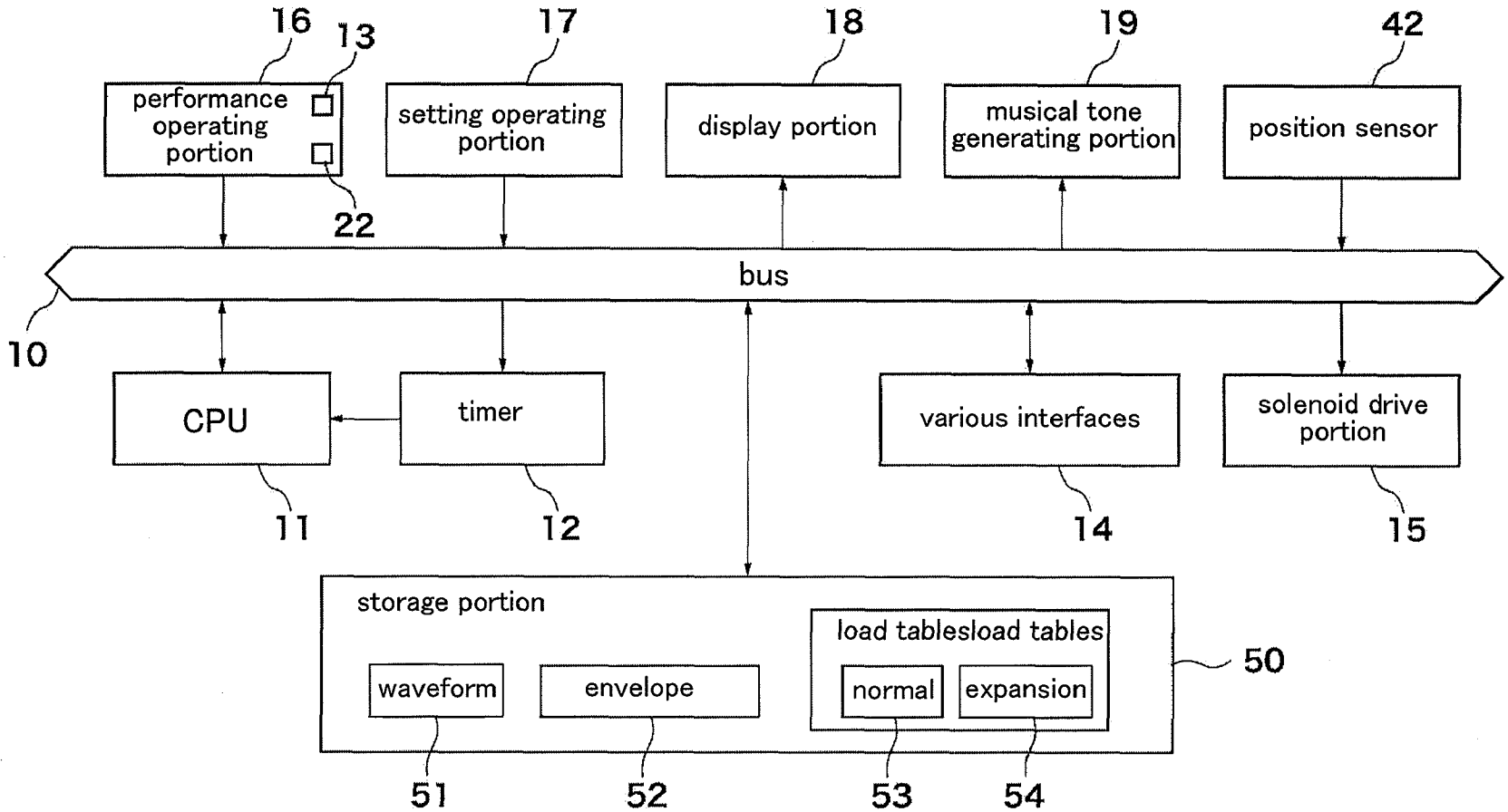
FIG. 1 is a block diagram showing a general configuration of an electronic keyboard musical instrument according to a first embodiment of the present invention.

FIG. 1 is a block diagram showing a general configuration of an electronic keyboard musical instrument according to a first embodiment of the present invention.

As shown in FIG. 1, this electronic keyboard musical instrument is configured such that a timer 12, a storage portion 50, various interfaces 14, a solenoid drive portion 15, a performance operating portion 16, a setting operating portion 17, a display portion 18, a musical tone generating portion 19 and a position sensor 42 are connected to a CPU 11, respectively, through a bus 10.

Figure 2:
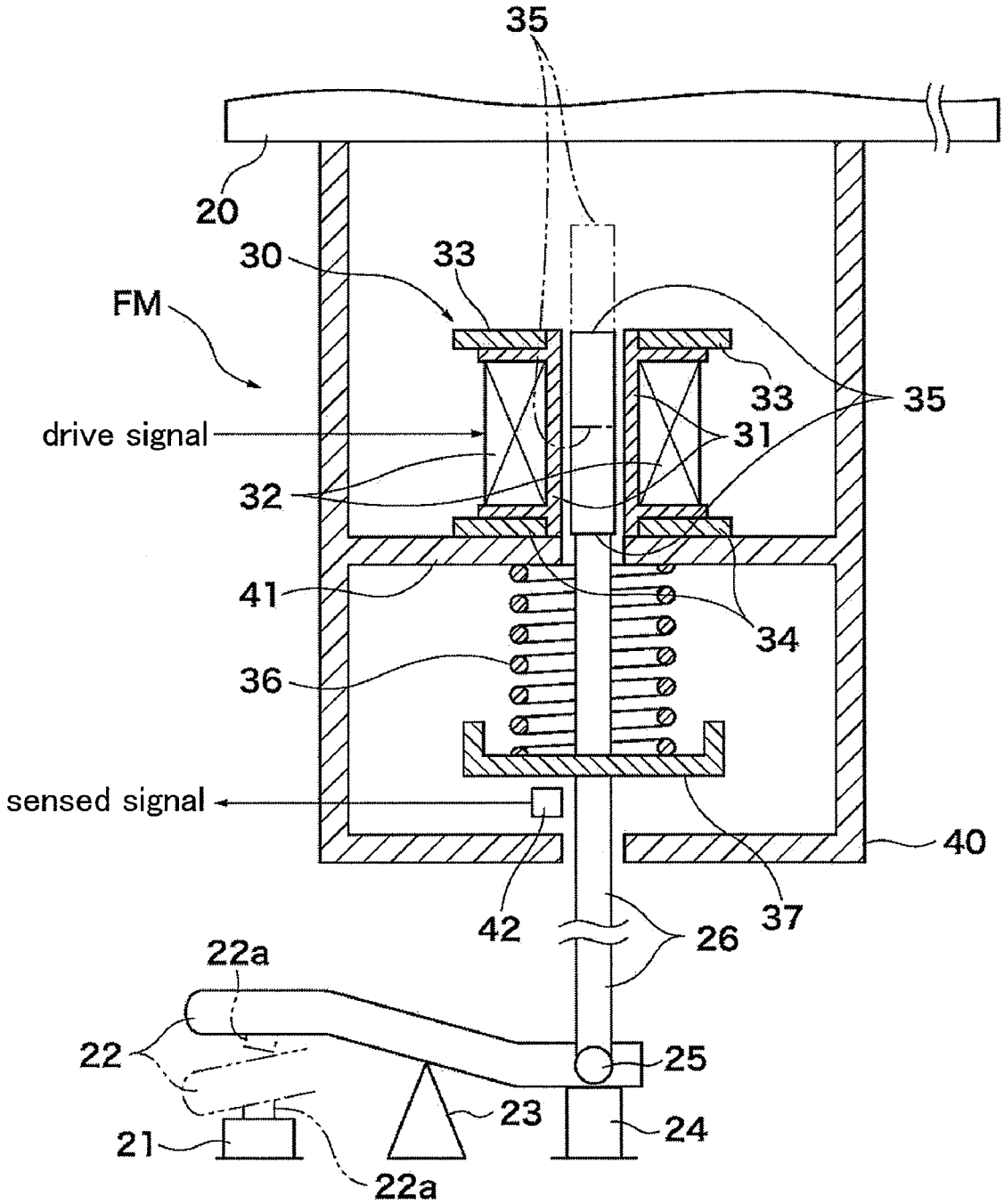
FIG. 2 is a cross sectional view of a main part of the electronic keyboard musical instrument.

The performance operating portion 16 includes a plurality of key operators 13 for inputting information on tone pitch, various performance operators and a pedal 22 which is manipulated for musical performance by a player with his foot (see FIG. 2). The pedal 22 functions as a damper pedal. However, the pedal 22 may function differently. The setting operating portion 17 includes various kinds of switches (not shown) for inputting various kinds of information. The display portion 18 displays various kinds of information such as a musical score and letters. The musical tone generating portion 19 includes a tone generator, an effect circuit and a sound system which are not shown. The musical tone generating portion 19 generates musical tone signals (performance signals) through the use of performance data input by the performance operating portion 16 and previously provided performance data, adds various kinds of effects to the signals, and converts the signals to which the various effects have been added into acoustic signals to emit musical tones.

The musical tone generating portion 19 is not necessarily required to be incorporated into the electronic keyboard musical instrument. For example, the electronic keyboard musical instrument may be configured such that the musical tone generating portion 19 is connected to the instrument via a network. More specifically, the electronic keyboard musical instrument may be configured as a network musical instrument system including the external musical tone generating portion 19 which is provided separately from the main body of the instrument. In the case of such a network musical instrument system, amplifiers and speakers can be brought into the system as needed so that the player can use the amplifiers and speakers in combination for his performance. The present invention can be applied to such a system as well.

The CPU 11 controls operation of the entire electronic keyboard musical instrument. The timer 12 measures various kinds of time such as interrupt time at a timer interrupt. The various interfaces 14 includes a MIDI (Musical Instrument Digital Interface) I/F and a wired/wireless communications I/F.

The storage portion 50 includes not only a ROM which stores control programs which are to be executed by the CPU 11 and various kinds of table data but also a RAM which temporarily stores various input information such as performance data and text data, various kinds of flags, buffer data, computation results and the like. In the ROM, for example, of the storage portion 50, not only waveform data 51 indicative of waveforms of musical tones to be generated and envelope data 52 indicative of envelopes of musical tones to be generated but also a normal load table 53 and an expansion load table 54 as load tables are stored. These tables and data will be explained later.

FIG. 2 is a cross sectional view of a main part of the electronic keyboard musical instrument. As illustrated in FIG. 2, the electronic keyboard musical instrument is provided with a reaction force generating mechanism FM for exerting, on the pedal 22, a force (reaction force) that resists depression of the pedal 22. The reaction force generating mechanism FM is interposed between a keyboard musical instrument main body 20 and the pedal 22. The pedal 22 is to be depressed downward. In this figure, an initial state where the pedal 22 is not depressed is illustrated in solid lines, while a state where the pedal 22 is being depressed is illustrated in chain double-dashed lines.

Commonly, a mechanism of the reaction force generating mechanism FM is installed inside a pedal box 40 provided below the keyboard musical instrument main body 20 (e.g., on the undersurface of a shelf board which is not shown). However, the mechanism may be installed anywhere as long as the mechanism can apply a reaction force to the pedal 22.

The pedal 22 is designed such that the tip (left end in FIG. 2) of the pedal 22 is pivotable upward and downward about a fulcrum 23. Through a pivot 25 provided at a rear end of the pedal 22, a rod 26 extending in a vertical direction is connected to the pedal 22, so that the rod 26 moves upward and downward in response to player's manipulation of the pedal 22. Beneath the rear end of the pedal 22, a stopper 24 is provided so that the stopper 24 is in contact with the rear end of the pedal 22 to restrict the position of the pedal 22 in a state where the pedal 22 is not being depressed.

Below a front end of the pedal 22, an elastic stopper 21 is provided. If the pedal 22 is depressed, a stopper contact portion 22*a* provided at the front end of the pedal 22 comes into contact with the stopper 21, so that the stopper 21 defines the end position of the depression of the pedal 22.

Inside the pedal box 40, a solenoid main body 30 is provided on a fixing portion 41. The solenoid main body 30 is designed such that a plunger 35 is provided inside a bobbin 31 so that the plunger 35 can move upward and downward. Around the bobbin 31, a solenoid coil 32 is wound. On and under the bobbin 31, yokes 33, 34 are provided. The plunger 35 is connected to the top end of the rod 26, so that the plunger 35 moves upward and downward in response to the pedal 22. The plunger 35 can be connected to the rod 26 either directly or indirectly as long as the plunger 35 moves in response to the pedal 22.

Below the fixing portion 41, a spring receiver 37 is connected to the rod 26. Between the spring receiver 37 and the fixing portion 41, a recovery coil spring 36 through which the rod 26 is penetrated is interposed. The coil spring 36 is provided so that the coil spring 36 is compressed to urge the rear end of the pedal 22 downward at all times. In a state where the pedal 22 is not being depressed, therefore, the rear end of the pedal 22 is urged downward to be in contact with the stopper 24.

Inside the pedal box 40, the position sensor 42 for sensing the vertical position of the rod 26 is provided. The position sensor 42 is a sensor which optically senses the position of the rod 26, for example. Signals sensed by the position sensor 42 indicate the position (depth) in the direction in which the pedal 22 is depressed as well as the vertical position of the plunger 35. The position sensor 42 may be configured in any other manner (optical sensor such as a photo-reflector and photo-interrupter, contact sensor, magnetic sensor, etc.) and be placed anywhere as long as the sensor can sense the depth of the depression of the pedal 22. In a case where the sensor is situated near the plunger 35, however, it is preferable that the sensor is not a magnetic sensor in view of influence of the solenoid coil 32.

The solenoid drive portion 15 (see FIG. 1) supplies drive signals to the solenoid main body 30 under the control of the CPU 11. As a result, the plunger 35 is urged downward to exert a force on the pedal 22 through the rod 26 in a direction resisting the depression. The drive signals are PWM signals whose pulse-width has been modulated to realize a duty ratio (%) specified in accordance with a target current value which is to pass through the solenoid coil 32 of the solenoid main body 30.

This musical instrument is designed such that a reaction force similar to that exerted by manipulation of a damper pedal (or loud pedal) of an acoustic grand piano is exerted on the pedal 22 by the reaction force generating mechanism FM when the pedal 22 is depressed and when the pedal 22 is released (recovers). In this embodiment, furthermore, two kinds of patterns in which a reaction force is exerted on the pedal 22 are provided: "normal mode" which imitates an acoustic grand piano and "expansion mode" in which a half pedal area is expanded, compared to the acoustic grand piano. These two modes can be switched by user's manipulation of the setting operating portion 17 (see FIG. 1).

Figure 3:
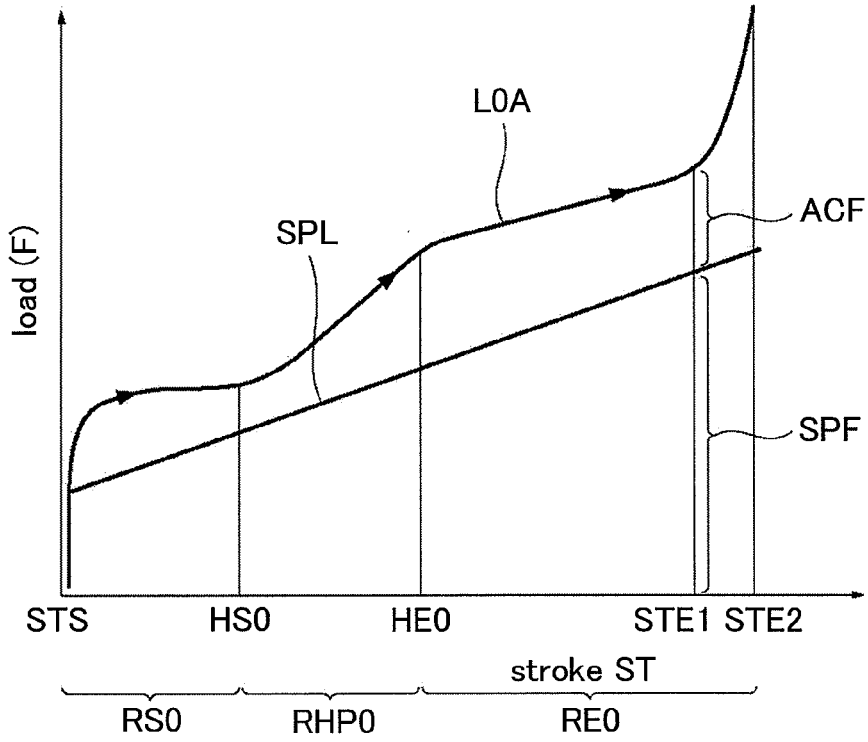
FIG. 3 is a diagram showing changes in the reaction force exerted when the pedal is depressed in normal mode.

FIG. 3 indicates changes in the reaction force exerted in the course of a depression of the pedal 22 in the normal mode. In FIG. 3, the horizontal axis indicates a stroke position (depth of a depression) ST of the pedal 22, while the vertical axis indicates a depression reaction force (load) F applied to the pedal 22.

In FIG. 3, a rightward ascending straight line SPL indicates the magnitude of depression reaction force produced only by the urging force of the coil spring 36 (area SPF) without depending on the solenoid main body 30. A curved line L0A indicates total depression reaction force F obtained by adding drive force by the solenoid main body 30 (area ACF) to the reaction force by the coil spring 36. The depression reaction force F from a stroke position STS which is a position where the pedal 22 is not depressed to a stroke position STE2 where the depression of the pedal 22 completes is controlled through the use of a normal load table 53 (see FIG. 1). An area ranging from a stroke position STE1 where the stopper contact portion 22*a* of the pedal 22 comes into contact with the stopper 21 (see FIG. 2) to the stroke position STE2 is the course within which the stopper 21 is pressed by the stopper contact portion 22*a* to be completely compressed. More specifically, the area is a phase in which the reaction force sharply increases because of the elasticity of the stopper 21.

In general, the course of a depression of the damper pedal of an acoustic grand piano includes three depression areas: "free area (i.e., rest area)", "half pedal area" and "string release area". The "free area" is an area where the depression has no effect on dampers. The "half pedal area" is an area ranging from a state where the contact pressure of the dampers on the strings starts decreasing to a state where the dampers leave the strings. The "string release area" is an area which follows the "half pedal area" to enter a state where the dampers are fully apart from the strings.

In FIG. 3, a shallow depression area ranging from the stroke start position STS to a half area start position HS0 is a first depression area RS0 equivalent to the "free area". A depression area ranging from the half area start position HS0 to a half area end position HE0 is a half pedal area RHP0. A deep depression area ranging from the half area end position HE0 to the stroke end position STE2 is a second depression area RE0 equivalent to the "string release area".

Figure 4:
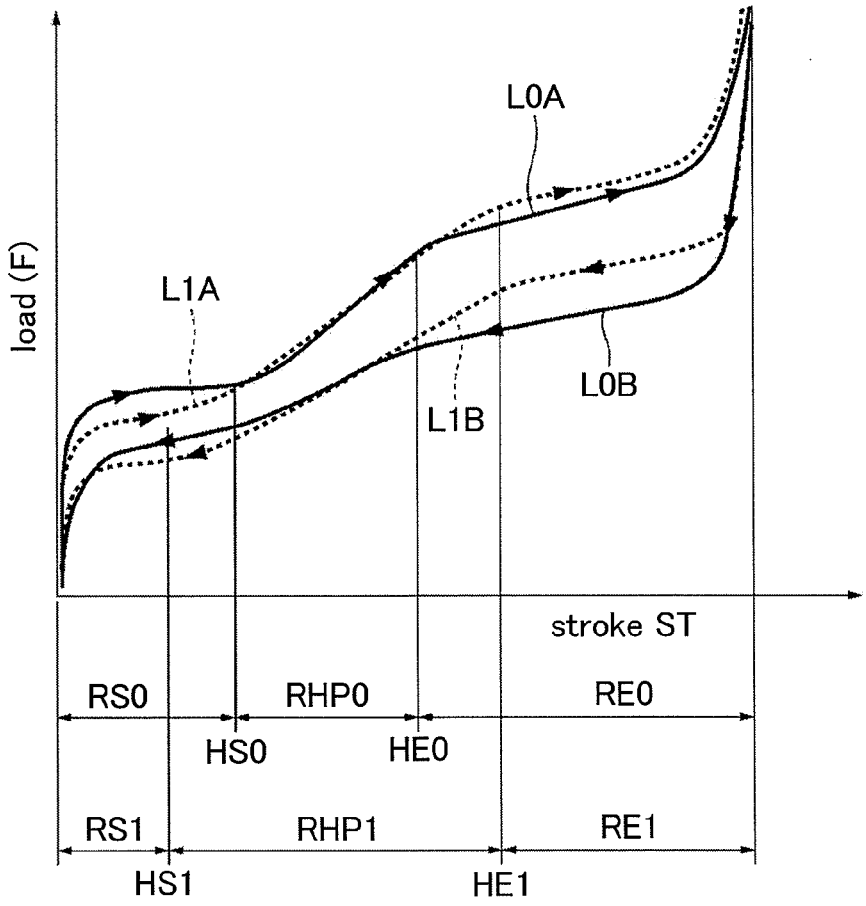
FIG. 4 is a diagram showing changes in the depression reaction force exerted on the pedal in normal mode and expansion mode, respectively.

FIG. 4 indicates changes in the depression reaction force F exerted on the pedal 22 in the normal mode and in the expansion mode, respectively.

In FIG. 4, a curved line L0B indicates the depression reaction force F in the course of a release of the pedal 22 in the normal mode. In the normal mode, the depression reaction force F is designed to exhibit hysteresis between the course of the depression of the pedal 22 (the curved line L0A) and the course of the release of the pedal 22 (the curved line L0B). In the normal mode, basically, the rate of change in the depression reaction force F with respect to the stroke position ST in the half pedal area RHP0 (gradient of the curved lines L0A, L0B) is larger than the rate of change in the first depression area RS0 and the second depression area RE0. Except the neighborhood of the stroke start position STS of the first depression area RS0 and the neighborhood of the stroke end position STE2 of the second depression area RE0, strictly speaking, the rate of change in the depression reaction force F in the half pedal area RHP0 is larger than the rate of change in the depression reaction force F outside the half pedal area RHP0. Furthermore, it should be noted that the rate of change in the depression reaction force F varies sharply when the stroke position ST passes through the half area start position HS0 and the half area end position HE0.

In the expansion mode, the depression reaction force F of the course of a depression is indicated by a curved line L1A, while the depression reaction force F of the course of a release is indicated by a curved line L1B. In the expansion mode, the half pedal area is a half pedal area RHP1, which is larger than that of the normal mode. Consequently, the half area start position is a half area start position HS1, which is closer to the non-depression position than the half area start position HS0 is. The half area end position is a half area end position HE1, which is closer to the depression end position than the half area end position HE0.

In the expansion mode, the half area start position HS1 and the half area end position HE1 serve as boundaries to provide separate areas: a first depression area RS1, the half pedal area RHP1, and a second depression area RE1. The expansion mode is similar to the normal mode in that hysteresis is provided and in that the rate of change in the depression reaction force F of the half pedal area RHP1 is basically large, compared to the rate of change in the depression reaction force F of the first depression area RS1 and the second depression area RE1.

Hereafter, in cases where the two modes are not especially distinguished, descriptions of "0" and "1" will be omitted to be simply expressed as follows: half area start position HS, half area end position HE, first depression area RS, half pedal area RHP, and second depression area RE.

In this embodiment, a later-described process shown in FIG. 5 enables the respective areas of the first depression area RS, the half pedal area RHP, the second depression area RE to have different musical tone parameters of musical tones to be generated in order to vary characteristics of the musical tones among the respective areas. In other words, the musical tone parameters are switched at the half area start position HS and the half area end position HE to control musical tones. Therefore, these positions are referred to as "effect-switchable positions" for the sake of convenience.

More specifically, for example, in order to imitate the pedal manipulation of an acoustic piano in the respective modes, this embodiment is designed such that in the second depression area RE, resonance tones (equivalent to tones generated by a depression of the damper pedal of the acoustic piano to produce resonance of every string) are added, and a release of a key will not result in forced vanishing of a corresponding musical tone. In the half pedal area RHP, the addition of resonance tones and the velocity of decay of a tone by a release of a key are controlled so as to correspond to those of the half pedal area of an acoustic piano. For instance, lower keys are designed to have slower decay velocity (to extend tones) at the time of release of keys.

In the respective modes, in addition to such control of musical tones, this embodiment also controls such that the depression reaction force F exhibits the curved lines as indicated in FIG. 4. Although there are various possible approaches for controlling musical tones and the reaction force, this embodiment employs, as an example, the control through the use of the waveform data 51, the envelope data 52, and the load tables (see FIG. 1).

Information on the half area start positions HS0, HS1 and the half area end positions HE0, HE1 is previously stored in the ROM, for example, of the storage portion 50 so that the information is correlated with the respective load tables. When the process of FIG. 5 is carried out, either of the information on the half area start position HS0 and the half area end position HE0 or the information on the half area start position HS1 and the half area end position HE1 required for the control is chosen according to the mode. The chosen information is then read out from the ROM to be stored in the RAM, for example, of the storage portion 50.

This embodiment allows the player to select a basic tone color of musical tones to be generated by use of the setting operating portion 17 (see FIG. 1). Both the waveform data 51 and the envelope data 52 are provided for the respective modes and the respective tone pitches so that the waveform data 51 and the envelope data 52 are correlated with selectable basic tone colors. The waveform data 51 and the envelope data 52 may be provided for every tone range commonly specified for the respective modes. The envelope data 52 is provided for the first depression area RS, the half pedal area RHP, and the second depression area RE, respectively.

By adding resonance tones by a later-described process, this embodiment varies tone color of musical tones to be generated according to the depth of depression of the pedal 22. In cases where the player is allowed to program various kinds of effects, some effects enable the tone color to be generated to subtly vary according to the depth of depression of the pedal 22. In this embodiment, therefore, a designated tone color which is a basic tone color to which any effect on tone color has not been added is particularly referred to as "basic tone color".

The waveform data 51 is provided for the first depression area RS and the second depression area RE separately, whereas the both waveform data 51 provided for the first and second depression area RS, RE are crossfaded in the half pedal area RHP. In the half pedal area RHP, more specifically, musical tones based on the waveform data 51 for the first depression area RS and musical tones based on the waveform data 51 for the second depression area RE are mixed at a ratio specified according to the stroke position ST of the pedal 22 to emit resultant musical tones. Thus, the crossfading realizes a natural link between the tone colors.

The waveform data 51 for the first depression area RS is used in order to generate normal musical tones that are to be emitted when keys are depressed without depression of the pedal 22. The waveform data 51 for the second depression area RE is used in order to generate musical tones that are to be emitted when keys are depressed with depression of the pedal 22. More specifically, the waveform data 51 for the second depression area RE is used in order to reproduce musical tones obtained by adding resonance tones to the normal musical tones (e.g., waveforms recorded in a state where, on an acoustic piano, the damper pedal is depressed to allow resonance of every string). The waveform data 51 for the second depression area RE may be replaced with waveform data for reproducing only resonance tones so that in a state where the pedal 22 is being depressed, not only the waveform data for reproduction of resonance tones but also the waveform data for the first depression area RS are used to generate musical tones including the resonance tones.

As for the load tables, the normal load table 53 for normal mode and the expansion load table 54 for expansion mode are provided. These tables contain information for generating driving force by the solenoid main body 30 (e.g., area ACF; see FIG. 3) so that the depression reaction force F exhibits a load profile as shown in FIG. 4 in the normal mode and the expansion mode, respectively.

In this embodiment, the width (area) of the half pedal area RHP varies between the modes. Such variations in the width of the half pedal area RHP are brought about by variations in the waveform data 51, the envelope data 52 and the load table that are to be chosen according to the mode.

Figure 5:
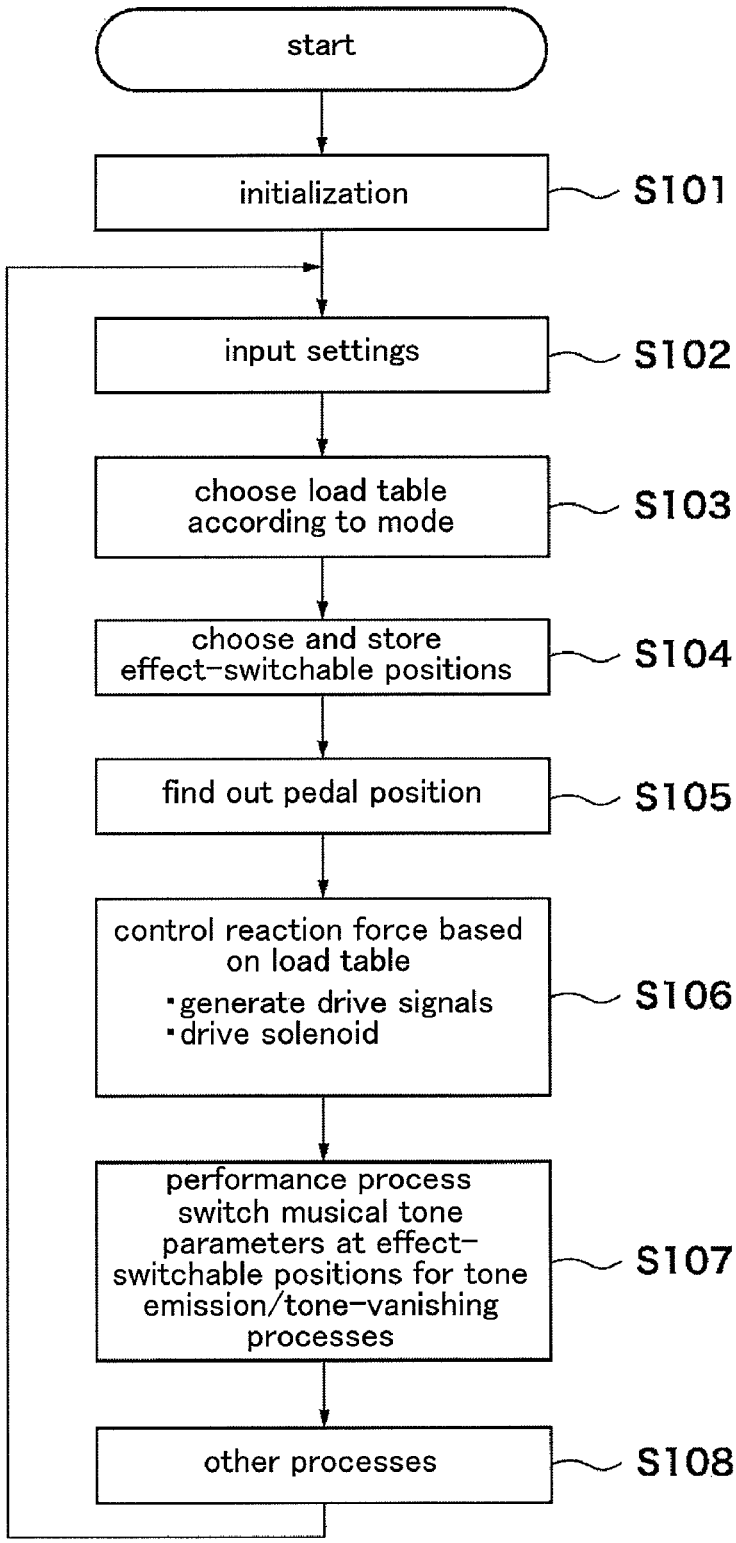
FIG. 5 is a flowchart of a main process carried out in this embodiment.

FIG. 5 indicates a flowchart of a main process carried out in this embodiment. This process is started when the power of this musical instrument is turned on, being carried out by the CPU 11.

First, initialization is done. That is, a certain program is started to set initial settings in various kinds of registers such as RAM (step S101). Then, manipulation of the setting operating portion 17 is accepted to carry out a setting input process (step S102). This process includes designation of a tone color of musical tones, mode setting, and setting of effect to be added to musical tones according to the manipulation of the pedal 22. This process is designed such that the settings are refreshed only if the setting operating portion 17 has been manipulated. If the setting operating portion 17 has not been manipulated, therefore, preset values that have been given in step S101 and the like are kept in step S103 and later steps.

Then, a load table is chosen according to the current mode (step S103). More specifically, if it is in the normal mode, the normal load table 53 is selected. If expansion mode, the expansion load table 54 is selected.

Then, the half area start position HS and the half area end position HE used for the control are chosen as "effect-switchable positions" according to the current mode to store the chosen positions in the RAM, for example, of the storage portion 50 (step S104). Then, the current stroke position ST of the pedal 22 is found out on the basis of the output from the position sensor 42 (step S105). Then, a reaction force control process is carried out (step S106).

In this reaction force control process, the load table selected in step S103 is referenced to determine the duty ratio so as to provide the depression reaction force F according to the stroke position ST of the pedal 22 to generate drive signals (PWM signals) having the determined duty ratio. Then, the solenoid drive portion 15 (see FIG. 1) outputs the drive signals of the determined duty ratio to the solenoid main body 30. By these steps, the reaction force generating mechanism FM is allowed to exert an appropriate reaction force on the pedal 22.

Then, a performance process is carried out (step S107). In this performance process, a tone emission process and a tone-vanishing process are carried out. In these processes, more specifically, musical tone parameters used for the control of musical tones to be generated are switched at the effect-switchable positions stored in the RAM in accordance with the manipulation of the pedal 22.

In the tone emission process, manipulation of the key operators 13 is detected. If a depression of a key is detected, more specifically, a musical tone, which is based on a tone pitch corresponding to the depressed key, a key velocity of the depressed key, a basic tone color, the stroke position ST of the pedal 22 and the like, is generated by the musical tone generating portion 19.

More specifically, the waveform data 51 and the envelope data 52 corresponding to the depressed key (tone pitch), the designated basic tone color and the depression area specified by the stroke position ST of the pedal 22 are selected. The selected waveform data 51 and the envelope data 52 are then read out to generate a musical tone signal obtained by adding an envelope according to the envelope data 52 to a musical tone waveform according to the waveform data 51. The musical tone signal is then transmitted to the musical tone generating portion 19 to be emitted as a musical tone.

In the expansion mode, for example, in a case where the stroke position ST is situated at a position which is deeper than the half area end position HE1, the waveform data 51 and the envelope data 52 corresponding to the basic tone color and the depressed key as well as to the second depression area RE1 (see FIG. 4) are used to generate a musical tone to which a resonance tone is added.

In a case where the stroke position ST of the pedal 22 falls within the half pedal area RHP, both the waveform data 51 corresponding to the first depression area RS and the waveform data 51 corresponding to the second depression area RE are read out, so that musical tone signals based on the both waveform data 51 are mixed at a ratio according to the stroke position ST to generate a musical tone, as described above.

The waveform data 51 may be separately provided for the half pedal area RHP as well. The waveform data 51 may be provided not for every tone pitch but for every few tone pitches so that the tone pitch varies according to reading rate.

In a case of release of a key, the tone-vanishing process such as a decay process based on the stroke position ST of the pedal 22 and the like is carried out for a musical tone corresponding to the released key.

More specifically, the waveform data 51 and the envelope data 52 corresponding to the released key (tone pitch), the designated basic tone color, and the depression area specified by the stroke position of the pedal 22 are selected. Then, musical tone signals obtained by adding the envelope corresponding to the selected envelope data 52 to the musical tone waveform corresponding to the selected waveform data 51 are generated. This process can be done by an art such as the one disclosed in Japanese Unexamined Patent Publication No. H7-84574, for example. Depending on the depression area, the target level and the decay time vary. The envelope data 52 may not be provided for the half pedal area RHP. In this case, interpolation is to be performed in the half pedal area RHP.

As for the musical tone control, the above-described art is an example. Therefore, known arts can be applied to the respective depression areas. For instance, file data corresponding to basic tone colors may be provided to be used for the musical tone control.

As described above, on the condition that the width of the half pedal area RHP (length in the stroke direction) varies depending on the mode, musical tones to be generated are controlled on the basis of the different musical tone parameters, namely, the waveform data 51 and the envelope data 52, depending on in which depression area the pedal 22 is situated.

Then, in step S108, "other processes" such as automatic performance process are carried out to return to the above-described step S102. In the automatic performance process, designated automatic performance data is read out to be amplified to be output with a specified effect being added to generated performance signals.

According to this embodiment, mode switching involves not only switching of selected load table but also changes to information on the effect-switchable positions which are timings to switch the musical tone control, the information being stored in the RAM of the storage portion 50. As a result, this embodiment enables the player to set his desired pedal depression positions where the musical tone control such as addition of effect switches.

In addition, this embodiment controls such that the rate of change in the reaction force to be exerted on the pedal 22 varies at the effect-switchable positions stored in the RAM of the storage portion 50. In this embodiment, therefore, the switching of the musical tone control is linked with the switching of the rate of change in reaction force so as to enable the player to perceive switchable positions of musical tone control by the depth of depression of the pedal with his foot.

In this embodiment, particularly, the width of the half pedal area RHP switches depending on the mode. In addition, the musical tone parameters for the musical tone control are replaced at the borders between the switchable half pedal area RHP and its neighboring areas, with the rate of change in reaction force also switching at the borders. In this case, the rate of change in reaction force sharply varies when the stroke position ST passes through the half area start position HS and the half area end position HE, respectively. Therefore, this embodiment facilitates even beginner's perception of the half pedal area RHP, also facilitating manipulation of the half pedal for users of all levels.

Although this embodiment is provided with two kinds of load tables so that the load tables are correlated with the two modes, three or more modes may be provided. In this case, three or more kinds of load tables are provided so that the load tables are correlated with the three or more modes with three or more kinds of effect-switchable positions being correlated with the modes. In this case as well, the mode is to be selected by player's manipulation.

Considering that the musical tone parameters are to switch when the position of the pedal 22 crosses over the effect-switchable positions, the half pedal area RHP is not necessarily required to have an area. That is, this embodiment may be designed such that the damper effect switches between enable/disable at a single effect-switchable position.

In addition, the normal load table 53 and the expansion load table 54 may be provided for each of selectable tone colors to allow switching of the effect-switchable positions on a selected tone color basis.

B. Second Embodiment

The first embodiment, which is provided with the half pedal area RHP, is expected to have selectable basic tone colors that decay such as piano. As the effect added by switching of the musical tone parameters, furthermore, the addition of resonance tones is adopted in the first embodiment. However, the second embodiment is primarily expected to have selectable tone colors that sustain such as the strings. As an example of effects added by switching of musical tone parameters, the second embodiment is designed to add a vibrato effect or the like which is one kind of after-touch control just before the end of a depression of the pedal.

This embodiment is provided with two selectable modes: first vibrato mode and second vibrato mode. The load tables stored in the ROM, for example, of the storage portion 50 are "first load table" and "second load table", instead of the normal load table 53 and the expansion load table 54.

Figure 6A:
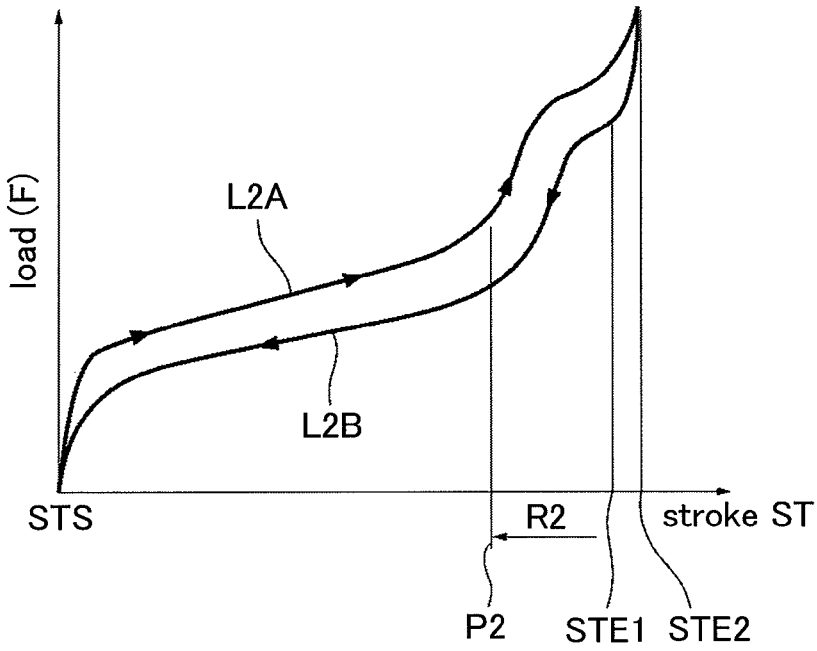
FIG. 6A indicates changes in the depression reaction force exerted on the pedal by use of a first load table in first vibrato mode in a second embodiment.
Figure 6B:
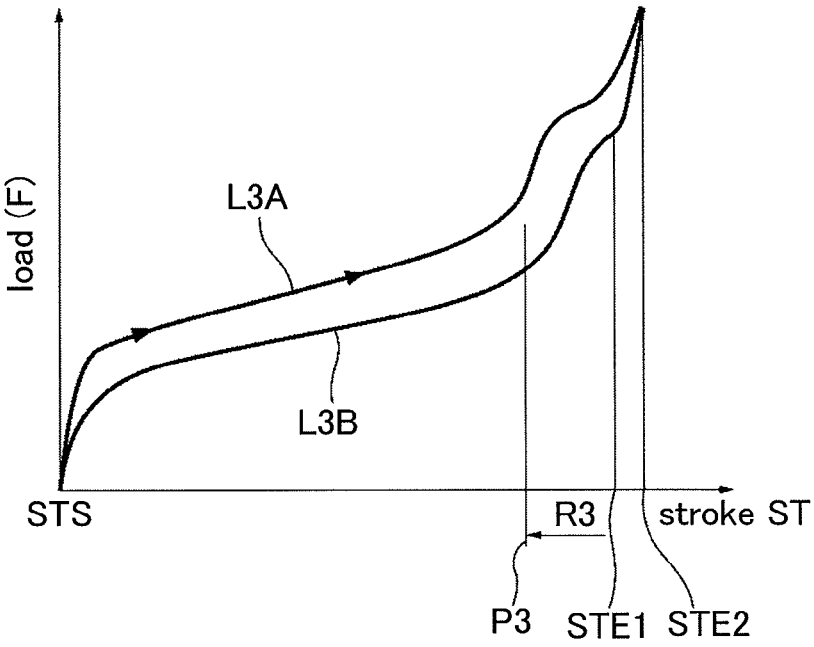
FIG. 6B indicates changes in the depression reaction force exerted on the pedal by use of a second load table in second vibrato mode in the second embodiment.

FIGS. 6A, 6B indicate changes in the depression reaction force F exerted on the pedal 22 by use of the first and second load tables in the first and second vibrato modes, respectively. Curved lines L2A, L2B of FIG. 6A indicate the depression reaction force F in the courses of a depression and a release of the pedal 22 in the first vibrato mode. Curved lines L3A, L3B of FIG. 6B indicate the depression reaction force F in the courses of a depression and a release in the second vibrato mode.

As for the control of the reaction force, as indicated in FIGS. 6A, 6B, in the both modes, in the course of a depression of the pedal 22, in areas R2, R3 which require deeper depression than effect-switchable positions P2, P3, the rate of increase in the depression reaction force F temporarily increases to form a convex shape. More specifically, the rate of change in the depression reaction force F grows at the effect-switchable positions P2, P3, and then temporarily decreases around stroke position STE1 before stroke position STE2 where the depression ends. Then, the rate of change rises from the stroke position STE1 to stroke position STE2.

The effect-switchable position P2 requires shallower depression than the effect-switchable position P3. Information on the effect-switchable positions P2, P3 is previously stored in the ROM, for example, of the storage portion 50 to be correlated with the first load table and the second load table, respectively, so that the information according to the mode is read out to be stored in the RAM, for example, of the storage portion 50.

As for the control of musical tones, musical tone parameters switch at the effect-switchable positions P2, P3 to control musical tones. Similarly to the first embodiment, the second embodiment performs the control of the reaction force and the control of musical tones by the process of FIG. 5.

An additional detailed explanation of FIG. 5 will now be given. In step S102 where an effect to be added to musical tones according to the manipulation of the pedal 22 is set, an effect other than the vibrato effect can be set. The effect other than the vibrato effect includes change in tone pitch other than vibrato, change in tone color such as characteristics of frequency, change in tone volume such as tremolo, pan and the like.

In step S103, either the "first load table" or the "second load table" is selected. In step S104, the effect-switchable position for control (either of the effect-switchable positions P2, P3) is stored in the RAM of the storage portion 50 according to the mode.

In the process for controlling the reaction force in step S106, the selected load table is referenced to control the reaction force to form a profile of the depression reaction force F according to the stroke position ST of the pedal 22.

In the performance process of step S107, a musical tone of a depressed key (tone pitch) in the designated basic tone color is emitted with musical tone parameters switching at the effect-switchable position (P2 or P3) stored in the RAM to carry out the tone emission process and the tone-vanishing process. In a case where the set effect is vibrato, for example, as long as the stroke position ST of the pedal 22 is deeper than the effect-switchable position, the vibrato effect is added. The constitution to add an effect such as vibrato is known. Therefore, such an addition of the effect can be done in any manner such as using tables and computation.

Similarly to the first embodiment, the second embodiment has the effect on allowing the player to set his desired pedal depression positions where the musical tone control such as addition of an effect switches. In addition to the switching of the musical tone control, the second embodiment enables separate switching of musical tone parameters on a musical tone basis. Therefore, the second embodiment realizes switching of the musical tone control for each of concurrently emitted tone colors. Furthermore, because switching of the musical tone control at the effect-switchable position is linked with the changes in the rate of change in the reaction force, the second embodiment enables the player to perceive, with his foot, the position where a musical tone changes by the addition of an effect such as after-touch effect.

The second embodiment may have three or more kinds of load tables. In this case, options for choosing a pedal depression position to switch the musical tone control increase with the number of kinds of the load tables.

The first and second embodiments may be designed to be realized simultaneously. In this case, more specifically, both the normal load table 53 and the expansion load table 54 of the first embodiment and the first load table and the second load table of the second embodiment are provided. Player's selectable modes include the normal mode and the expansion mode of the first embodiment and the first and second vibrato modes of the second embodiment.

If the basic tone color designated by the player is the one that decays, either the normal load table 53 or the expansion load table 54 is to be selected depending on whether it is in the normal mode or in the expansion mode. If the basic tone color designated by the player is the one that sustains, either the first load table or the second load table is to be selected depending on whether it is in the first vibrato mode or in the second vibrato mode.

This modification enables the player to specify his desired pedal depression position at which the musical tone control such as addition of effect switches for each designated tone color.

C. Third Embodiment

In the third embodiment of the present invention, the first and second embodiments are combined to allow the player to designate two different basic tone colors to have a tone color that decays and a tone color that sustains, respectively. The third embodiment enables concurrent generation of musical tones of the two different tone colors by a depression of one of the key operators 13. The third embodiment also enables the player to specify, for each tone color, an effect to be added by the manipulation of the pedal 22.

The third embodiment provides four selectable modes: first normal mode, second normal mode, first expansion mode and second expansion mode. The load tables stored in the ROM or the like of the storage portion 50 include four different load tables: first normal load table, second normal load table, first expansion load table and second expansion load table. These load tables are correlated with the four different modes, respectively.

Figure 7A:
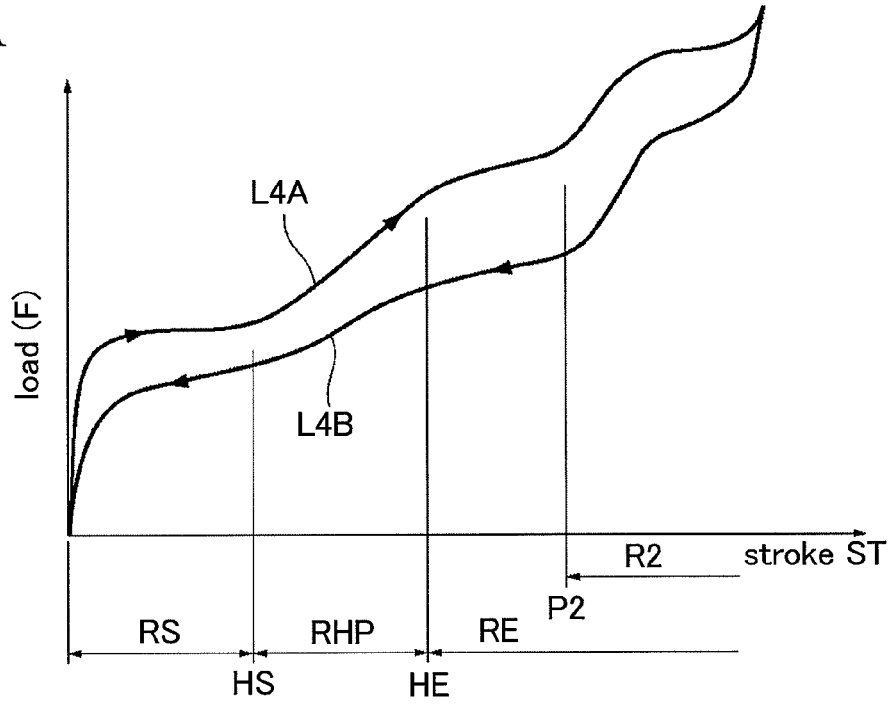
FIG. 7A indicates changes in the depression reaction force exerted on the pedal by use of a first normal load table in first general mode in a third embodiment.

FIG. 7A indicates changes in the depression reaction force F exerted on the pedal 22 by use of the first normal load table in the first normal mode. The first normal mode is the mode in which the normal mode of the first embodiment is combined with the first vibrato mode of the second embodiment. The shapes of curved lines L4A, L4B indicated in FIG. 7A are obtained by combining the shapes of the curved lines L0A, L0B (see FIG. 4) (mainly, the shapes near the half pedal area RHP) with the shapes of the curved lines L2A, L2B (see FIG. 6A) (mainly, the shapes near the end position of the pedal depression).

Figure 7B:
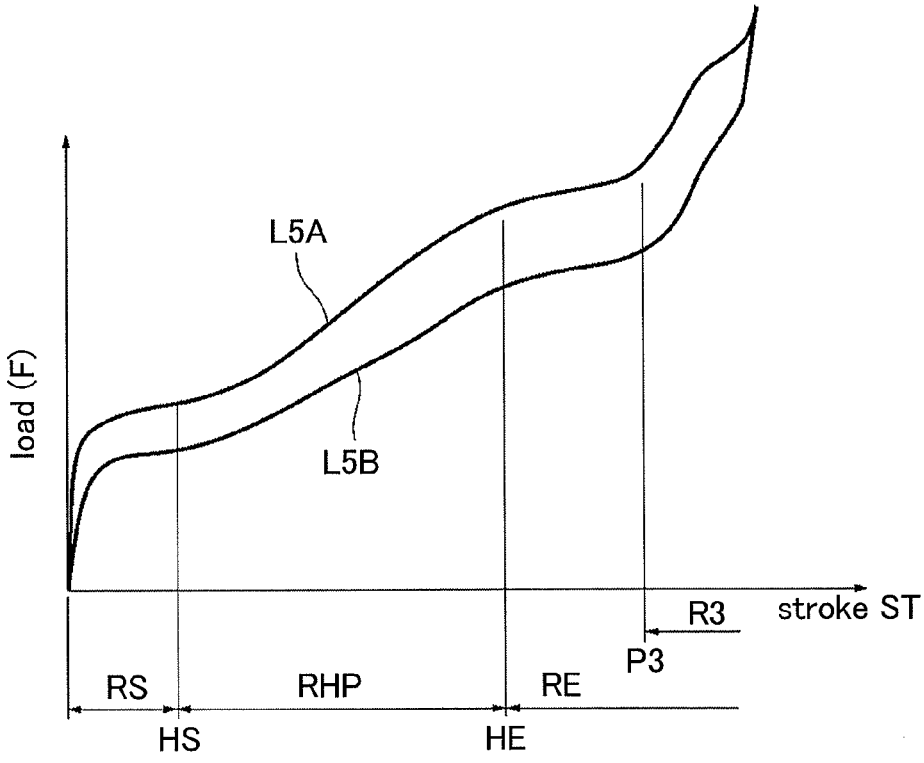
FIG. 7B indicates changes in the depression reaction force exerted on the pedal by use of a second expansion load table in second expansion mode in the third embodiment.

FIG. 7B indicates changes in the depression reaction force F exerted on the pedal 22 by use of the second expansion load table in the second expansion mode. The second expansion mode is the mode in which the expansion mode of the first embodiment is combined with the second vibrato mode of the second embodiment. The shapes of curved lines L5A, L5B indicated in FIG. 7B are obtained by combining the shapes of the curved lines L1A, L1B (see FIG. 4) (mainly, the shapes near the half pedal area RHP) with the shapes of the curved lines L3A, L3B (see FIG. 6B) (mainly, the shapes near the end position of the pedal depression).

The second normal mode is the mode in which the normal mode is combined with the second vibrato mode. The first expansion mode is the mode in which the expansion mode is combined with the first vibrato mode. Although the shapes of waveforms of the depression reaction force F in these modes are not shown, the manner of the combinations is similar to those indicated in FIGS. 7A, 7B. That is, the second normal mode is obtained by combining the curved lines L0A, L0B (see FIG. 4) with the curved lines L3A, L3B (see FIG. 6B). The first expansion mode is obtained by combining the curved lines L1A, L1B (see FIG. 4) with the curved lines L2A, L2B (see FIG. 6A).

The reaction force control is carried out in accordance with the load table which is correlated with the mode. As for the musical tone control, in the first normal mode (FIG. 7A), as for the decaying tone color which is the first tone color of the basic tone colors, similarly to that described for the first embodiment, musical tone parameters switch at the half area start position HS and the half area end position HE which are the effect-switchable positions. More specifically, this embodiment controls whether or not to add resonance tones and the degree of addition at the half pedal area RHP. As for the sustaining tone color which is the second tone color of the basic tone colors, similarly to that described for the second embodiment, musical tone parameters switch at the effect-switchable position P2. At the area R2, that is, a specified effect such as vibrato is to be added.

In the second expansion mode (FIG. 7B), similarly, musical tone parameters switch at the half area start position HS, the half area end position HE and the effect-switchable position P3, respectively. In this embodiment, as described above, musical tones of the two different tone colors are controlled separately, with the reaction force being commonly controlled in accordance with the same load table.

This embodiment enables the player to set, for each of the different tone colors that are to be emitted concurrently, his desired pedal depression positions where the musical tone control such as addition of an effect switches. This embodiment is similar to the first and second embodiments in that the musical tone control is linked with the reaction force control so that the player can perceive, with his foot, the positions where musical tone control switches.

In this embodiment as well, five or more different kinds of load tables may be provided. Furthermore, three or more basic tone colors that are to be emitted concurrently may be provided to allow the above-described separate control of musical tones for each tone color.

Although this embodiment is designed such that the basic tone colors are designated by the user, tone colors may be determined in a different manner. More specifically, a plurality of tone colors may be previously fixed so that the reaction force control and the musical tone control are carried out for musical tones of the tone colors, providing the player with variable effect-switchable positions.

Although the load tables are used for the control of the depression reaction force F in the above-described embodiments, the use of the load tables is a mere example. That is, the control of the depression reaction force F may be done in different manners. For instance, load data according to mode may be stored to obtain a load profile according to the stroke position ST by computation.

In addition, the musical tone parameters which switch at the effect-switchable positions for the musical tone control are not limited to the waveform data 51 and the envelope data 52. That is, various kinds of musical tone parameters can be adopted, such as the one for adding an effect such as vibrato, pan and tremolo, and the one for gradually varying tone color or tone pitch. The various kinds of musical tone parameters widely include musical tone parameters for switching effects or enabling/disabling an effect at an effect-switchable position.

The reaction force (the area SPF indicated in FIG. 3) which serves as the base exerted by the urging force of the coil spring 36 is not necessarily required. Theoretically, that is, the entire reaction force may be generated by the solenoid main body 30.

Furthermore, the source of the reaction force corresponding to the area SPF indicated in FIG. 3 may not be limited to the coil spring 36. That is, the reaction force corresponding to the area SPF may be generated by friction, inertial force and the like.

The mechanism for exerting the controlled reaction force (the area ACF indicated in FIG. 3) on the pedal 22 may not be limited to the solenoid main body 30 but may be any mechanism such as motor as long as the mechanism can control magnitude of the reaction force.

What is claimed is:

1. An electronic keyboard musical instrument comprising:

musical tone signal generating means for generating a musical tone signal;

a plurality of key operators;

a pedal;

position sensing means for sensing position of the depressed pedal;

position storing means for storing as a switchable position at least one position in a direction in which the pedal is depressed;

musical tone controlling means for controlling the musical tone signal generating means by use of a musical parameter in accordance with manipulation of the key operators and manipulation of the pedal to generate a musical tone signal as well as switching the musical tone signal which is to be generated by switching the musical tone parameter when the depressed pedal position sensed by the position sensing means crosses over the switchable position stored in the position storing means; and position changing means for changing the switchable position stored in the position storing means in accordance with a user's manipulation.

2. An electronic keyboard musical instrument according to claim 1 wherein, the pedal is a damper pedal; and the musical tone controlling means switches the musical tone parameter to switch between generation of a musical tone signal without a resonance tone and generation of a musical tone signal with a resonance tone.

3. An electronic keyboard musical instrument according to claim 2 wherein, the musical tone parameter is waveform data indicative of a waveform of a musical tone to be generated.

4. An electronic keyboard musical instrument according to claim 1 wherein, the musical tone controlling means switches the musical tone parameter to switch between generation of a musical tone signal without vibrato and generation of a musical tone signal with vibrato.

5. An electronic keyboard musical instrument according to claim 1 wherein, the musical tone signal generating means concurrently generates musical tone signals of different kinds of tone colors;

the position storing means stores, for each of the respective tone colors, as a switchable position at least one position in the direction in which the pedal is depressed;

the musical tone controlling means switches, for each of the respective tone colors, the musical tone parameter to switch the musical tone signal to be generated when the depressed pedal position sensed by the position sensing means crosses over the switchable position stored in the position storing means; and the position changing means changes, for each of the respective tone colors, the switchable position stored in the position storing means in accordance with a user's manipulation.

6. An electronic keyboard musical instrument according to claim 1 further comprising:

reaction force generating means for generating reaction force against depressing manipulation of the pedal; and reaction force controlling means for controlling the reaction force generating means in accordance with the depressed pedal position sensed by the position sensing means;

the reaction force controlling means varying rate of change in the reaction force exerted on the pedal at least when the depressed pedal position sensed by the position sensing means crosses over the switchable position stored in the position storing means.

7. An electronic keyboard musical instrument according to claim 6 wherein, the switchable position stored in the position storing means includes a first and second positions situated between a position where a depression of the pedal starts and a position where the depression of the pedal ends; and the reaction force controlling means controls the reaction force generating means so that, in a course of the depression of the pedal, the rate of change in the reaction force to be exerted on the pedal grows at the first position and decreases at the second position.

8. An electronic keyboard musical instrument according to claim 6 wherein, the switchable position stored in the position storing means is near the position where the depression of the pedal ends; and the reaction force controlling means controls the reaction force generating means so that, in a course of the depression of the pedal, the rate of change in the reaction force to be exerted on the pedal grows at the switchable position and temporarily decreases just before the position where the depression ends.

9. An electronic keyboard musical instrument according to claim 1 further comprising:

reaction force generating means for generating reaction force against depressing manipulation of the pedal;

load data storing means for storing different kinds of load data each indicative of reaction force which is to be exerted on the pedal and varies according to the depressed pedal position;

selecting means for selecting, in accordance with a user's manipulation, any of the different kinds of load data stored in the load data storing means; and reaction force controlling means for controlling the reaction force generating means by use of the selected load data in accordance with the depressed pedal position sensed by the position sensing means;

the position changing means changing the switchable position stored in the position storing means in response to the selection of the load data by the selecting means.

* * * * *